US006941662B2

(12) United States Patent
Chen

(10) Patent No.: US 6,941,662 B2
(45) Date of Patent: Sep. 13, 2005

(54) SHAVING HEAD ASSEMBLY FOR A LINT SHAVER

(76) Inventor: Wen-Cheng Chen, No. 32, Lin 9, Haipuzai, Chaoyang Village, Zaociao Hsiang, Miaoli Hsien (TW)

( * ) Notice: Subject to any disclaimer, the term of this patent is extended or adjusted under 35 U.S.C. 154(b) by 64 days.

(21) Appl. No.: 10/979,495

(22) Filed: Nov. 1, 2004

(65) Prior Publication Data

US 2005/0132575 A1 Jun. 23, 2005

(30) Foreign Application Priority Data

Nov. 20, 2003 (TW) ..... 92132568 A

(51) Int. Cl.[7] ..... B26B 19/16; B26B 19/14
(52) U.S. Cl. ..... 30/206; 30/133
(58) Field of Search ..... 30/206, 133, 216, 30/223, 228, 208, 210, 34.2, 41, 43.6, 41.5, 30/41.6, 43.4, 43.5, 347; 173/73, 80, 104; 15/344, 352, 347

(56) References Cited

U.S. PATENT DOCUMENTS 2,166,025 A * 7/1939 Schwarz ..... 30/43
2,770,989 A * 11/1956 Bologno ..... 81/9.5
2,980,994 A * 4/1961 Stachon ..... 30/133
3,094,732 A * 6/1963 Mandy et al. ..... 15/250.02
3,224,305 A * 12/1965 Silver et al. ..... 83/14
3,512,419 A * 5/1970 Stiles ..... 74/5
3,900,949 A * 8/1975 Anzalone ..... 30/133
4,150,483 A * 4/1979 Kanazawa ..... 30/133
4,188,719 A * 2/1980 Hoff ..... 30/122
4,788,769 A * 12/1988 Maruyama ..... 30/133
4,868,984 A * 9/1989 Elsherbini ..... 30/133
4,899,442 A * 2/1990 Horii et al. ..... 30/133
5,031,364 A * 7/1991 Belanger ..... 451/359
5,226,205 A * 7/1993 Pearce ..... 15/1.7
5,421,056 A * 6/1995 Tateyama et al. ..... 15/302
6,381,853 B1 * 5/2002 Parke ..... 30/207
D472,024 S * 3/2003 Caldwell ..... D32/32
6,711,822 B1 * 3/2004 Ginns ..... 30/206

* cited by examiner

*Primary Examiner*—Allan N. Shoap
*Assistant Examiner*—Ghassem Alie
(74) *Attorney, Agent, or Firm*—Dellett & Walters

(57) ABSTRACT

A shaving head assembly for a lint shaver includes a transmission shaft rotatably received inside the casing and having a V-shaped cutout defined in a distal end of the transmission shaft. The blade assembly has a blade seat with a V-shaped extension extending from a bottom of the blade seat to be securely received in the V-shaped cutout yet movable relative to the transmission shaft so that the blade seat is able to move upward and downward relative to the transmission shaft. A rotor is fixedly connected to a free end of the transmission shaft and rotatably received in the casing.

14 Claims, 4 Drawing Sheets

SHAVING HEAD ASSEMBLY FOR A LINT SHAVER

BACKGROUND OF THE INVENTION

1. Field of the Invention

The present invention relates to a lint shaver, and more particularly to the shaving head assembly for a lint shaver to reduce the wear of the blade of the shaving head.

2. Description of Related Art

A conventional lint shaver is equipped with a blade assembly received inside a cap having multiple slits. When the blade assembly is rotated via the motor inside the shaver, lint is removed from surfaces of clothes. Although the purpose of removal of lint is accomplished, the lint shaver is easily worn due to the constant contact of the blade assembly with the bottom face of the cap. Because of the design, the blade assembly is in contact with the bottom face of the cap no matter the lint shaver is shaving off the lint or not and this is the primary reason for the wear of the blade assembly of the lint shaver.

To overcome the shortcomings, the present invention tends to provide an improved shaving head assembly for the lint shaver to mitigate the aforementioned problems.

SUMMARY OF THE INVENTION

The primary objective of the present invention is to provide an improved shaving head assembly to selectively contact with the bottom face of the cap so that wear of the blade assembly is reduced.

To accomplish the objective of the present invention, the shaving head assembly is composed of a transmission shaft and a blade assembly. The transmission shaft is provided with a V-shaped cutout and the blade assembly has a V-shaped extension corresponding to and in contact with the V-shaped cutout such that when the shaving head assembly of the lint shaver is not operating, the V-shaped extension of the blade assembly is in contact with the V-shaped cutout of the transmission shaft without engagement with the bottom face of the cap and when the shaving head assembly of the lint shaver is operating, the resistance from the lint slows the rotation of the blade assembly such that the blade assembly is pushed outward by the periphery defining the V-shaped cutout to engage with the bottom face of the cap to perform the lint removal.

Other objects, advantages and novel features of the invention will become more apparent from the following detailed description when taken in conjunction with the accompanying drawings.

DETAILED DESCRIPTION OF THE PREFERRED EMBODIMENT

Figure 1:
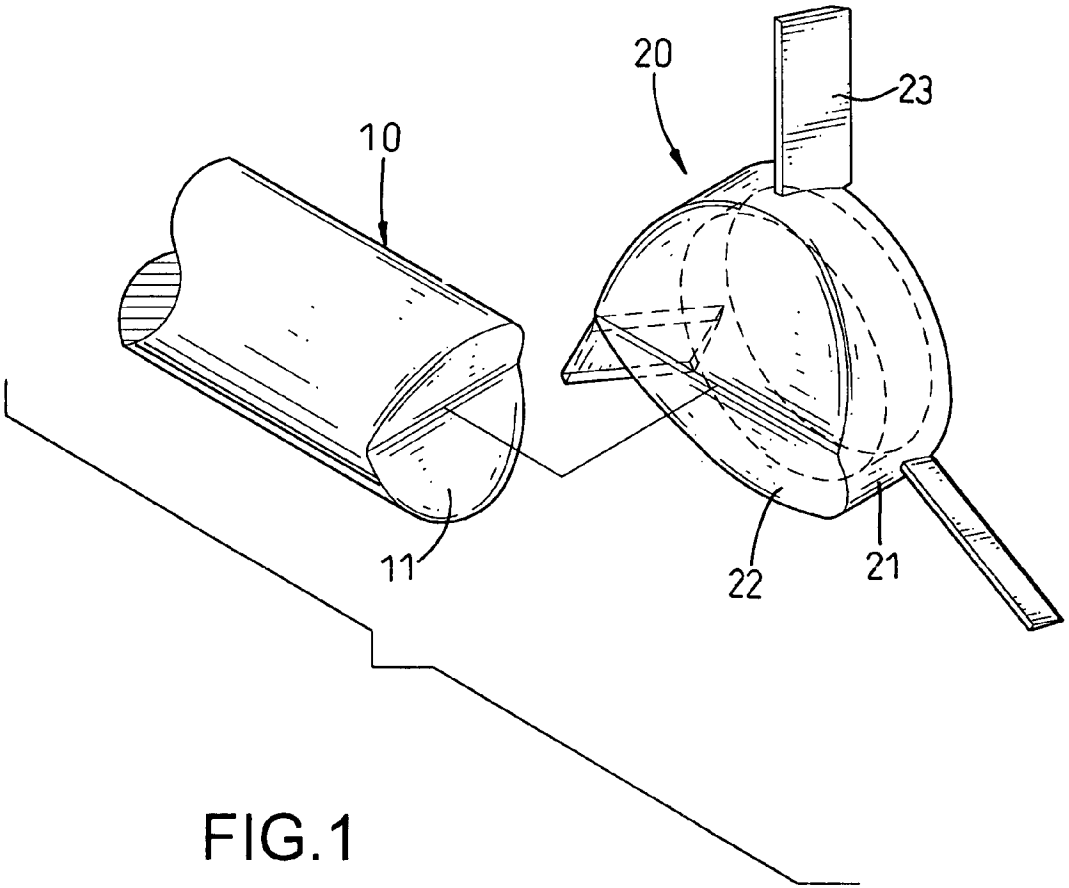
FIG. 1 is an exploded perspective view showing the design concept of the shaving head assembly of the present invention.

With reference to FIG. 1, the shaving head assembly in accordance with the present invention includes a driving shaft (10) and a blade assembly (20).

The driving shaft (10) is provided with a V-shaped cutout (11). The blade assembly (20) includes a cylindrical blade seat (21), a V-shaped extension (22) extending from a bottom face of the blade seat (21) to correspond to the V-shaped cutout (11) of the transmission shaft (10) and multiple blades (23) axially extending out of the blade seat (21).

When the V-shaped extension (22) is received in the corresponding V-shaped cutout (11), rotation of the blade assembly (20) is synchronous with that of the transmission shaft (10). That is, the blade assembly (20) moves together with the transmission shaft (10). However, when the blade assembly (20) of the present invention is used to shave off lint, the resistance from the lint slows the rotation of the blade assembly (20). Therefore, a periphery defining the V-shaped cutout (11) pushed the V shaped extension (22) out of the V-shaped cutout (11) to execute the lint removal objective. Therefore, only when the blade assembly (20) is actually shaving off the lint, is the blade assembly (20) pushed to engage with the bottom face of the cap such that wear of the blade assembly is reduced. The concept of the shaving head assembly of the present invention is easy assimilated with the depiction of FIG. 1, but is not limited to the embodiment as shown.

Figure 2:
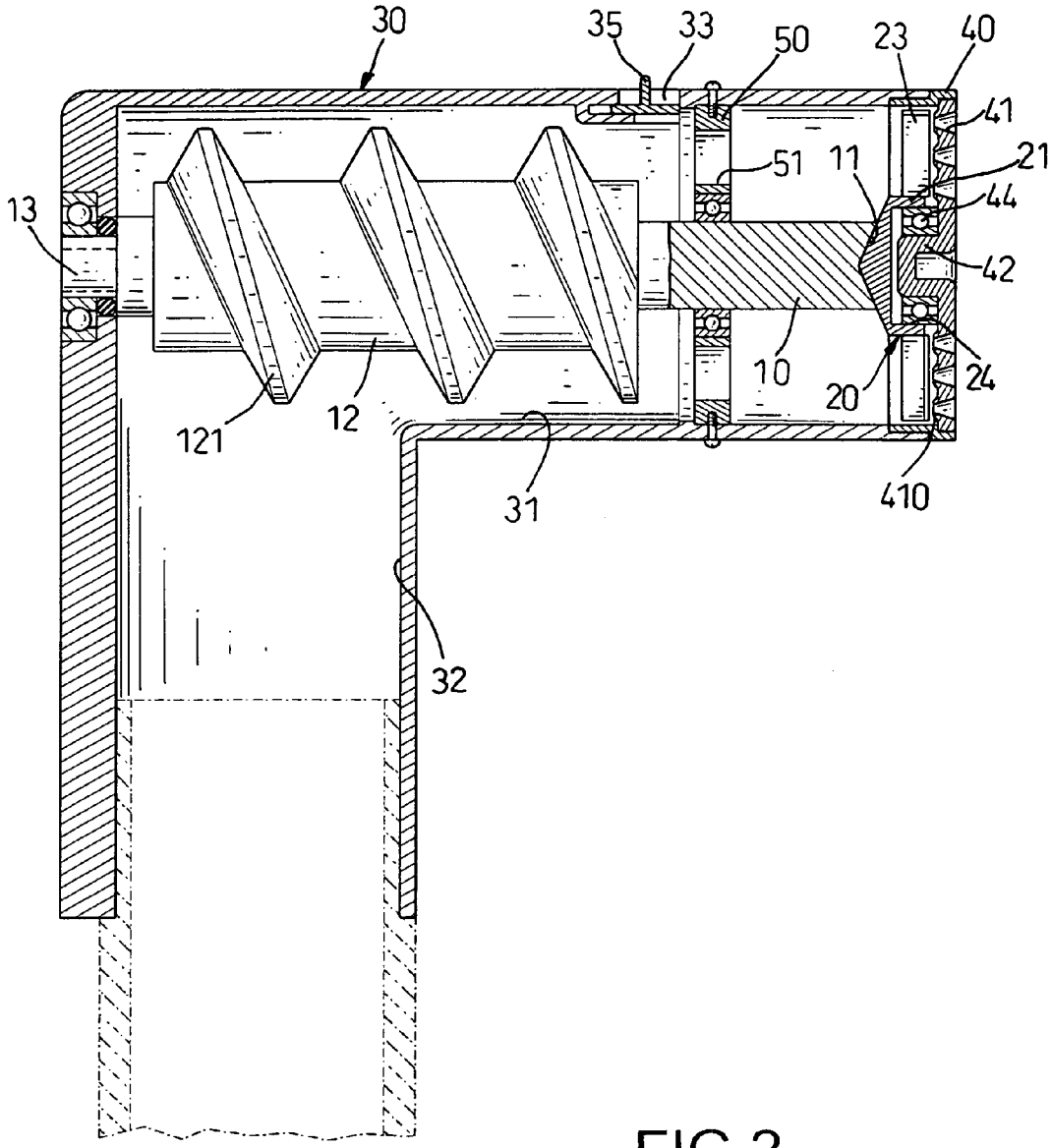
FIG. 2 is a schematic cross sectional view showing the structure of the shaving head assembly of the present invention.
Figure 3:
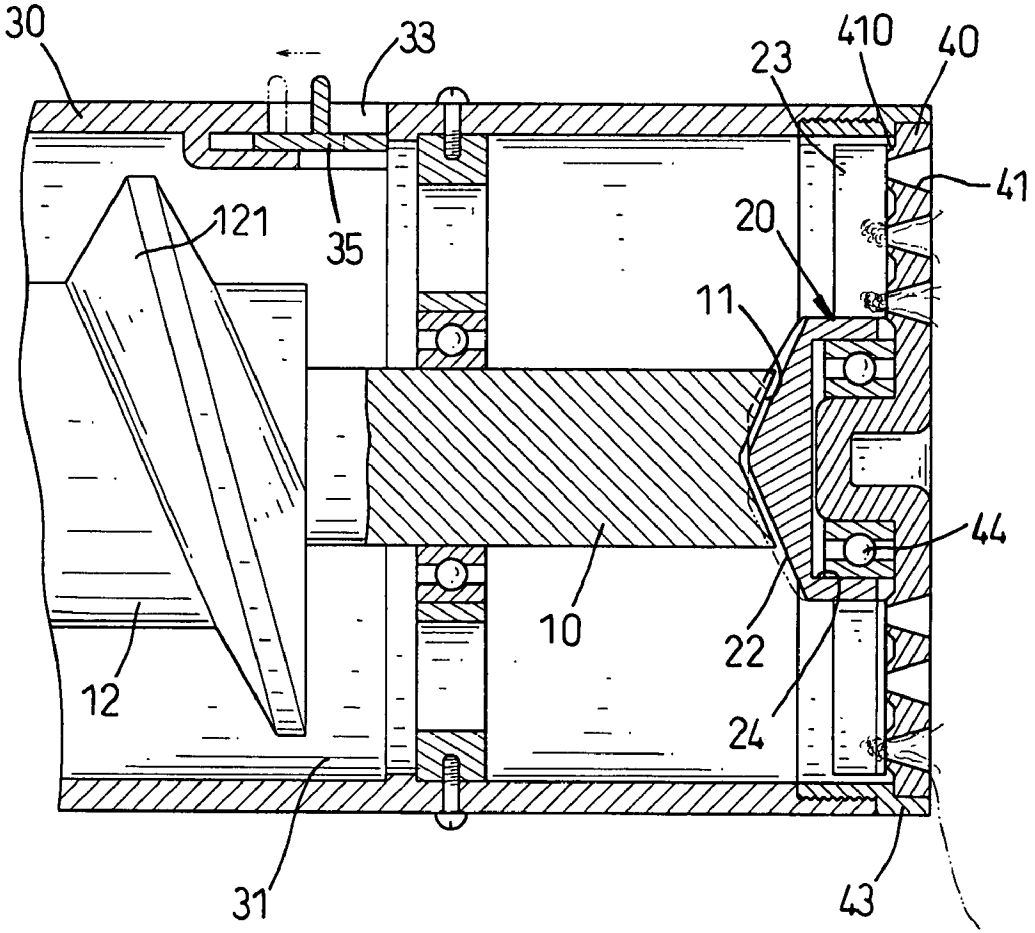
FIG. 3 is an enlarged view of FIG. 2.

With reference to FIGS. 2 and 3, it is noted that the shaving head assembly for a lint shaver having a cap (40) mounted on an open end of a casing (30) is provided with a transmission shaft (10) and a blade assembly (20).

The transmission shaft (10) has a V-shaped cutout (11) defined in a distal end thereof, a rotor (12) fixedly connected to a proximal end of the transmission shaft (10) and having multiple spirally and intermittently formed teeth (121) formed on an outer periphery of the rotor (12) and a pivot (13) extending out of a free end of the rotor (12).

The blade assembly (20) has a blade seat (21), a V-shaped extension (22) extending out from a bottom of the blade seat (21), multiple blades (23) axially and divergently extending out from an outer periphery of the blade seat (21) and a recess (24) defined in a top face of the blade seat (21).

The casing (30) is a tube like element and is divided into an intake portion (31) and an exhaust portion (32) in communication with the intake portion (31). The intake portion (31) has an opening and the cap (40) is mounted on a periphery defining the open end of the intake portion (31) to close the intake portion (31). The exhaust portion (32) has an open end adapted for connection with a bag (not shown) for receiving lint shaved off by the blade assembly (20). A window (33) is defined in a side face of the casing (30) to communicate with an interior of the casing (30) and a door (35) is able to alternatively close the window (33) in order to adjust suction force generated by the rotation of the rotor (12).

The cap (40) has multiple slits (41) defined through the cap (40), two bosses (410) each formed on a bottom side face of the cap (40) to be opposite to one another, an extension (42) extending out from a bottom face of the cap (40) to correspond to the recess (24) of the blade seat (21) and a bearing (44) mounted around an outer face of the extension (42) to be received in the recess (24) of the blade assembly (20).

A bracket (50) is mounted within the casing (30) to support the transmission shaft (10) and provided with vents (51) such that articles shaved by the blades (23) are able to be directed by the suction force to the exhaust portion (32).

Figure 4:
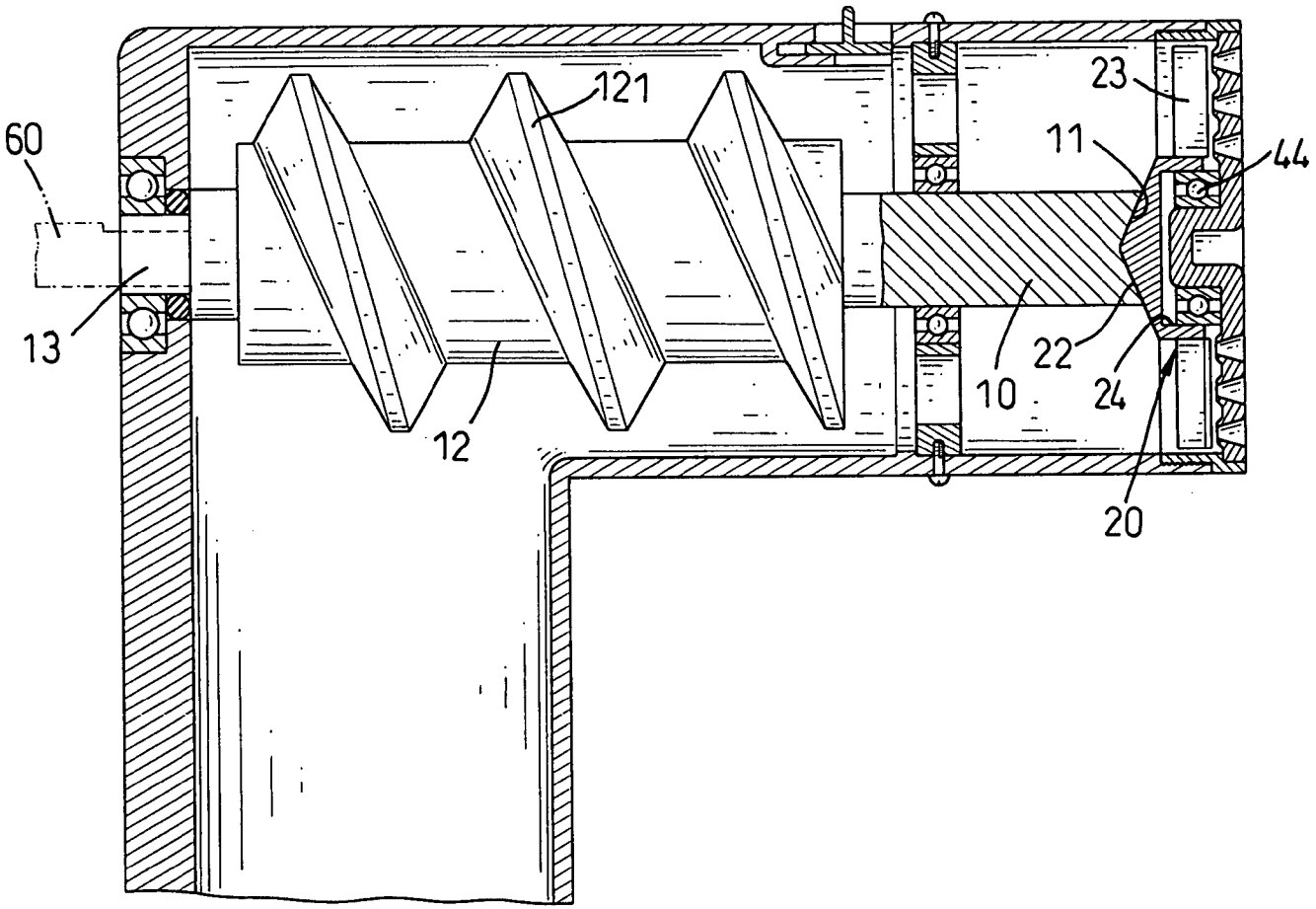
FIG. 4 is a schematic view showing that a motor shaft is connected to the shaving head assembly of the present invention to drive the blade assembly to rotate.

With reference to FIG. 4, when the lint shaver is in application, a motor shaft (60) is connected to the pivot (13) to drive the pivot (13) to rotate. Due to the direct connection between the pivot (13) and the rotor (12), the rotor (12) is driven to rotate accordingly. Suction force out of the rotation of the helically and intermittently formed teeth (121) is generated from the rotation of the rotor (12). Furthermore, due to the provision of the bearing (44), the blade assembly (20) is able to rotate freely within the V shaped cutout (11) of the transmission shaft (10).

Therefore, when there is nothing to shave, the blade assembly (20) rotates and is securely received inside the V-shaped cutout (11) without engagement with the cap (40), but when there is lint inserted into the slits (41), the blades (23) starting shaving off the lint. That is, because the lint slows the rotation of the blade assembly (20), the periphery defining the V-shaped cutout (11) pushes upward the V-shaped extension (22) of the blade assembly (20) to have the blades (23) abutted bottom faces of the bosses (410) of the cap (40). As a consequence, the lint inserted into the slits (41) is shaved off from clothes.

Furthermore, by moving the door (35) to allow the exterior and interior of the casing (30) to alternately communicate with each other, the suction force from the rotation of the rotor (12) is adjusted. Still, the size of the window (33) is also adjustable by the movement of the door (35), which also has the effect to adjust the suction force. After the lint is shaved off from the clothes, the suction force drives the debris toward the exhaust portion (32) to be collected by the bag connected to the open end of the exhaust portion (32).

In summary, because the blades (23) of the blade assembly (30) only engage with the casing (40) when the lint is inserted through the slits (41), wear of the blades (23) is greatly reduced and thus the life span of the blades (23) is prolonged. Also, cost for maintenance to the shaving head assembly is low.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shaving head assembly for a lint shaver having a tube like casing divided into an intake portion and an exhaust portion, a cap provided to an open end of the intake portion to close the open end and having multiple slits defined through the cap, and a blade assembly selectively rotatable relative to the cap and having multiple blades radially extending out of the blade assembly, the shaving head assembly comprising:

a transmission shaft rotatably received inside the casing and having a V-shaped cutout defined in a distal end of the transmission shaft;

wherein the blade assembly has a blade seat with a V-shaped extension extending from a bottom of the blade seat to be securely received in the V-shaped cutout yet movable relative to the transmission shaft so that the blade seat is able to move upward and downward relative to the transmission shaft; and a rotor fixedly connected to a free end of the transmission shaft and rotatably received in the casing.

2. The shaving head assembly as claimed in claim 1 further comprising a pivot rotatably extending out of the casing and fixedly connected to a free end of the rotor, the pivot being adapted for connection with a motor shaft so that the pivot, the rotor and the transmission shaft are able to be rotated.

3. The shaving head assembly as claimed in claim 2, wherein the blade seat has a recess to receive an extension formed on a bottom face of the cap and a bearing mounted around the extension so that the blade seat is able to rotate freely relative to the cap.

4. The shaving head assembly as claimed in claim 1, wherein the rotor has multiple intermittently and helically formed teeth formed on an outer periphery of the rotor to generate suction force for attraction of cuttings shaved off by the blades and passing through the slits of the cap.

5. The shaving head assembly as claimed in claim 2, wherein the rotor has multiple helically and intermittently formed teeth on an outer periphery of the rotor to generate suction force for attraction of articles inserted through the slits and shaved by the blades.

6. The shaving head assembly as claimed in claim 3, wherein the rotor has multiple helically and intermittently formed teeth on an outer periphery of the rotor to generate suction force for attraction of articles inserted through the slits and shaved by the blades.

7. The shaving head assembly as claimed in claim 6 further having a bracket securely formed in the casing to support the transmission shaft, the bracket having multiple vents defined for allowing the cuttings to be sucked further into the casing.

8. The shaving head assembly as claimed in claim 1, wherein the cap has a boss formed on a peripheral edge of the cap to engage with the blades when the blade seat is pushed upward by a periphery defining the V-shaped cutout.

9. The shaving head assembly as claimed in claim 2, wherein the cap has a boss formed on a peripheral edge of the cap to engage with the blades when the blade seat is pushed upward by a periphery defining the V-shaped cutout.

10. The shaving head assembly as claimed in claim 3, wherein the cap has a boss formed on a peripheral edge of the cap to engage with the blades when the blade seat is pushed upward by a periphery defining the V-shaped cutout.

11. The shaving head assembly as claimed in claim 4, wherein the cap has a boss formed on a peripheral edge of the cap to engage with the blades when the blade seat is pushed upward by a periphery defining the V-shaped cutout.

12. The shaving head assembly as claimed in claim 5, wherein the cap has a boss formed on a peripheral edge of the cap to engage with the blades when the blade seat is pushed upward by a periphery defining the V-shaped cutout.

13. The shaving head assembly as claimed in claim 6, wherein the cap has a boss formed on a peripheral edge of the cap to engage with the blades when the blade seat is pushed upward by a periphery defining the V-shaped cutout.

14. The shaving head assembly as claimed in claim 7, wherein the cap has a boss formed on a peripheral edge of the cap to engage with the blades when the blade seat is pushed upward by a periphery defining the V-shaped cutout.

* * * * *